United States Patent [19]

Iwao

[11] 4,307,459

[45] Dec. 22, 1981

[54] SELF-ADVANCING TEACHING DEVICE

[75] Inventor: Noriaki Iwao, Tokyo, Japan

[73] Assignee: Tomy Kogyo Co., Inc., Tokyo, Japan

[21] Appl. No.: 150,282

[22] Filed: May 16, 1980

[30] Foreign Application Priority Data

Jun. 11, 1979 [JP] Japan ..... 54-79273[U]

[51] Int. Cl.[3] ..... G04B 45/00; G04B 19/00

[52] U.S. Cl. ..... 368/45; 368/76

[58] Field of Search ..... 368/45, 62, 69, 76, 368/77, 80, 220–222; 35/1 R, 39, 4 G

[56] References Cited

U.S. PATENT DOCUMENTS

| | | | |
|---|---|---|---|
| 3,002,335 | 10/1961 | Kripak | 368/45 |
| 3,561,153 | 2/1971 | Harper | 46/1 |
| 3,747,328 | 7/1973 | Wiukler | 58/57.5 |
| 4,015,346 | 4/1977 | Ogasawara | 35/39 |

*Primary Examiner*—Vit W. Miska

*Attorney, Agent, or Firm*—K. H. Boswell; Edward D. O'Brian

[57] ABSTRACT

A time teaching device which gives a numerical readout to teach a child the position of clock hands and is capable of advancing the clock hands every time the child activates the readout portion has a housing in which is located a clock face and typical hour and minute clock hands. Within the housing are two carrier members which have a plurality of indicia thereon which indicate numerically the position of the clock's hands. The carrier members are located in the housing beneath display openings. Interspaced between the display openings and the carriers is an interference member which normally interferes with viewing of the indicia on the carrier. Both the hands and the carriers are coordinated such that movement of the minute hand will move the hour hand and both of the carriers through appropriate increments. An operator member is located on the housing and when it is depressed into the housing the indicia corresponding to the positions of the hands is viewable. Upon release of the operator member the interference member interferes with viewing of the indicia while simultaneously the hands advance an increment of time and concurrently unseen to the child the indicia carriers move to advance the indicia to correspond to the new positions of the hands.

12 Claims, 7 Drawing Figures

10
12
16
18
20
24
26
28
30
34
35
36
38
40
42
44
46
48
50
55
60
62
64
70
71
74
76
78
80
82
84
86
116
120
126
128
132
134

10
12
26
34
36
40
48
50
52
55
56
64
66
68
70
72
74
76
78
80
82
84
86
92
110
111
112
114
116
118
120
122
128
130
5
6
7

10
12
34
36
36
36
36
40
40
40
40
40
40
52
56
58
60
64
66
68
70
72
74
76
78
88
90
96
96
100
102
104
106
108
110
112
114
116
118
120
122
124
126
128
130

SELF-ADVANCING TEACHING DEVICE

BACKGROUND OF THE INVENTION

A teaching device is described which is shaped as a wristwatch and aside from being capable of telling a child numerically what time the clock hands indicate the device is further capable of changing the position of the clock hands each time the child has to refer to the numerical readout portion of the device.

All children seem to universally go through the frustrations of learning to tell time. It is very difficult for a child to have to put together the abstract concepts of having a clock face divided into 12 numbers coupled with hearing references such as "20 minutes after two" when in fact the clock has one hand pointed to the numeral 4 and one hand somewhere between the two and three.

The exasperation of the child from situations such as that described above and other situations summarized in the background section of U.S. Pat. No. 4,015,346 assigned to the same assignee as this patent application, the entire disclosure of which is hereby incorporated by reference, has led to the construction of devices to help a child learn to tell time. The device in the above named patent is one such device. Other such devices are described in U.S. Pat. No. 2,539,025, U.S. Pat. No. 3,203,115 and British Pat. No. 17,281.

While the above noted devices all have certain utility none of them constitute portable devices which the child can wear on his person at all times and thus be more apt to use throughout the day. That is to say all of the above devices are directed to clock-type time telling machines and not to wristwatch-type time telling machines. In attempting to emanate adults, a child will wear a wristwatch-like device. If during the child's day he is able to refer to his wristwatch device whenever he sees adults doing the same he is exposed to a greater extend to the learning capabilities of this device compared to a toy which is large and bulky and therefore acceptable for playing with for limited time periods.

Toy wristwatches are, of course, known. One such toy wristwatch is described in U.S. Pat. No. 3,561,153. This toy wristwatch, unfortunately, does not have the cabability of teaching the child how to coordinate the position of the clock hands with the actual time. Instead this toy teaches the child what activities are usually associated with a particular time such as getting on a school bus at 9 a.m., etc.

While the stationary clock-like teaching devices noted above do indicate numerically what time the hands are pointing to they do not automatically advance the hands once the child has looked at that portion of the device wherein the numerical indicators are located. Because of this the child is not forced to use his reasoning powers each time but can rely on his memorization powers. In the above device because the hands do not move each time the child refers to the numerical indicators the child can simply memorize what a particular hand position is. It is only when the child learns that basis behind the coordination between the hands and the numerical indicators that the child truly masters the correct telling of time.

SUMMARY OF THE INVENTION

In view of the above it is an object of this invention to provide a time teaching device which is portable and therefore can be strapped to the child much as a wristwatch, which incorporates a system coordinating a numerical indicator with clock hand positions and which automaticaly advances the hands after each time the child refers to the numerical indicator. It is a further object to provide a device which because of its simplicity of construction is easy to operate by the child yet is economical to manufacture and therefore economically available for use by the child.

These and other objects as will become evident from the remainder of this specification are achieved by providing a teaching device which comprises: a housing; a simulated clock face and at least one rotating hand located in association with said clock face, both said clock face and said hand located on said housing in position viewable external said housing; said hand capable of being positioned in a plurality of sequential positions with respect to said clock face; an indicia carrier means movably mounted on said housing, said indicia carrier means including at least one surface, a plurality of indicia located on said surface, said plurality of indicia each individually corresponding to one of said positions of said hand with respect to said clock face; said housing including an indicia display means, said indicia carrier means located in association with said indicia display means such that that individual indicia which corresponds with the current position of said hand with respect to said clock face is positioned in a position rendering it capable of being viewed external said housing and is differentiated with respect to said indicia carrier means from all other indicia not corresponding with the current position of said hand with respect to said clock face; interference means associated with said indicia display means and having an interference position wherein said interference means interacts with said indicia display means such that said individual indicia corresponding to the current position of said hand with respect to said clock face is not viewable external said housing and a non-interference position wherein said indicia corresponding to the position of said hand with respect to said clock face is capable of being viewed external said housing; hand advancing means associated with said hand and capable of advancing said hand from each of its positions with respect to said clock face to the next sequential of said positions of said hand with respect to said clock face; coupling means coupling the movement of said hand and said indicia carrier means such that when said hand advances from a position with respect to said clock face to the next sequential position with respect to said clock face said indicia carrier means moves such that the individual indicia corresponding to the sequential position said hand advanced to is positioned in a position rendering it capable of being viewed external said housing and is differentiated with respect to said indicia carrier means from all other indicia not corresponding to the sequential position of said hand with respect to said clock face; operator means at least a portion of which is located external said housing in a position to be operated on by a user of the teaching device, said operator means operatively associated with both said interference means and said hand advancement means and capable when being acted on by said user to first move said interference means from said interference position to said non-interference position allowing viewing external said housing of said individual indicia which correspond to the current position of said hand with respect to said clock face and next to essentially simultaneously cause (a) said interference means to move to said interference position, (b) said hand advancement means to advance said hand to said next sequential position of said hand with respect to said clock face, (c) in response to said hand being advanced to said sequential position said indicia carrier means moving to position the individual indicia corresponding to the sequential position said hand advanced to with respect to said clock face in a position rendering it capable of being viewed external said housing and differentiating with respect to said indicia carrier means from all other indicia not corresponding to the sequential position of said hand with respect to said clock face.

Preferably the teaching device has two hands—a primary hand and a secondary hand—both associated with each other and both capable of assuming a plurality of positions with respect to the clock face. Included are hand coordinating means which coordinate the movement of the primary hand and the secondary hand such that the primary hand will move from one position to the next position in response to movement of the secondary hand through a plurality of positions which are equal to the period between two sequential positions of the primary hand. Two indicia carrier means are included one corresponding to the primary hand and one corresponding to the secondary hand. Both include a surface containing a plurality of indicia corresponding to the positions of the hands. A carrier coordinating means coordinates the movement of the indicia carriers to correspond to the coordination of the movement of the primary and secondary hands. A coupling means is associated with both the hand coordinating means and the carrier coordinating means to couple the movement of the hands with the movement of the two indicia carrier means. Both of the indicia carrier means are located in association with the indicia display means such that the individual indicia on both of the indicia carrier means which corresponds to the current positions of the primary and secondary hands are viewable outside of the housing. The advancing means is associated with the secondary hand to advance the secondary hand and indirectly associated with the primary hand via the hand coordinating means.

Preferably the housing has a hollow interior and the indicia display means comprise at least one opening to this interior. The interference means comprises an interference member which is movable within the interior of the housing in association with the opening to block viewing through the opening in the interference position and to allow for viewing through the opening in the non-interference position.

The hand advancing means includes a gripping member accessible outside of the housing to the user of the toy to allow for repositioning of the hands. The operator means includes an operator member a portion of which is slidably mounted within the interior and a portion of which extends outside of the housing. The interference member is operatively coupled to the operator member. The hand advancing means includes a hand activation means operatively coupled to the operator member and capable of causing advancement of the hands in response to movement of the operator member.

Preferably the indicia carriers comprise rotatably mounted members and the carrier coordinating means comprise an appropriate first gear train associated with these members. The hand coordination means preferably include a shaft having the secondary hand attaching thereto and a disk fitting over the shaft having the primary hand attached thereto. The shaft and the disk are interconnected via a second gear train associated with them.

Preferably the hand activation means includes the shaft attaching to a ratchet disk and the operator member including a pawl flexibly mounted to it. The pawl is positioned to interact with the ratchet disk. A biasing means biases the operator member from a depressed position to an extended position. A third gear train connects the gears associated with the hands with the gears associated with the rotary mounted indicia carrier members.

BRIEF DESCRIPTION OF THE DRAWINGS

This invention will be better understood when taken in conjunction with the drawings wherein.

Figures 1, 5, 6, 7:
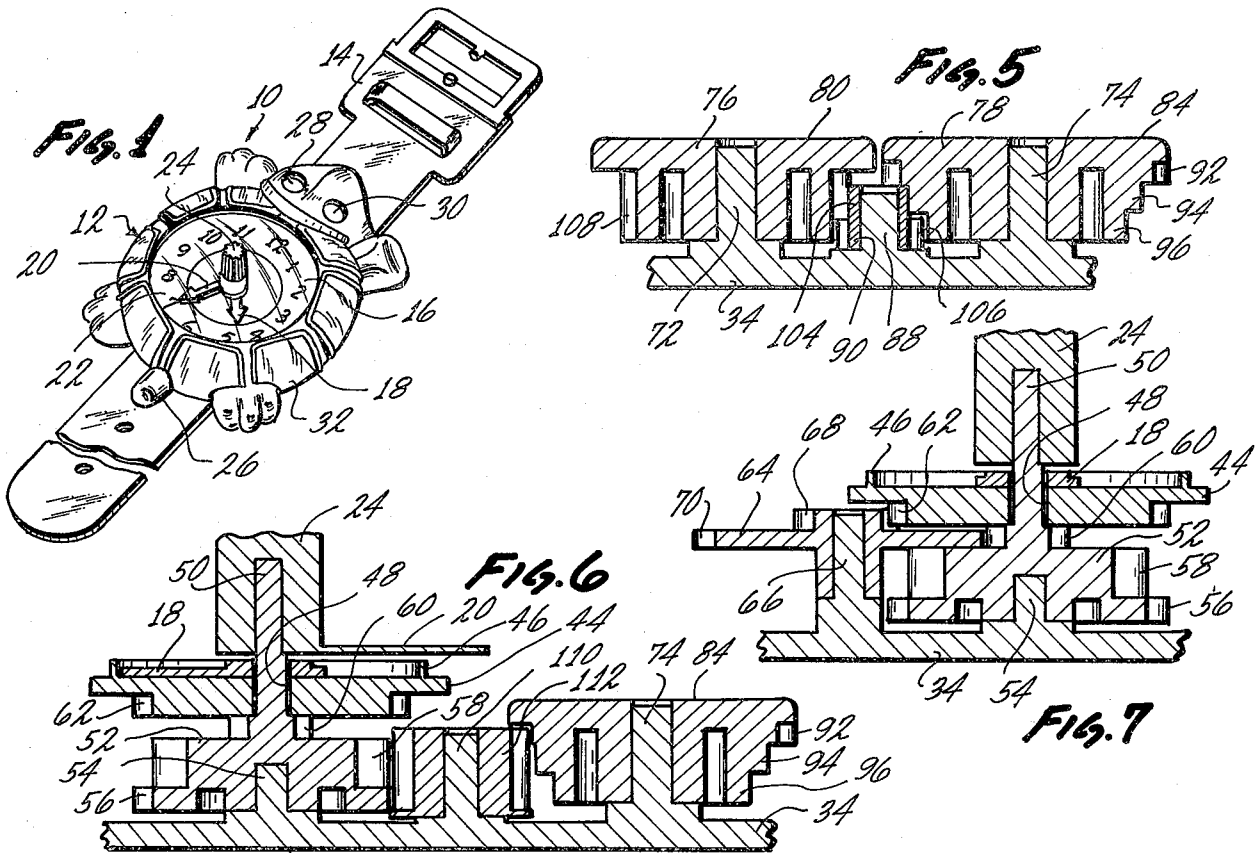
FIG. 1 shows an isometric view of the teaching device of the invention.
FIG. 5 is a side elevational view of certain components in section about the line 5—5 of FIG. 3.
FIG. 6 is a side elevational view of certain components in section about the line 6—6 of FIG. 3.
FIG. 7 is a side elevational view of certain components in section about the line 7—7 of FIG. 3.

This invention utilizes certain principles and concepts as set forth in the claims appended to this specification. Those skilled in the art to which this invention pertains will realize that these principles and concepts could be utilized in a number of differently appearing embodiments without departing from the spirit and scope of this invention. For these reasons this invention is to be construed in light of the claims and is not to be construed as being limited to the exact embodiments herein depicted in this specification and shown in the drawings.

DETAILED DESCRIPTION

The teaching device 10 of the invention has a body 12 which attaches to a child's wrist by a strap 14. The strap 14 is attached to the body 12 in a conventional manner which is not illustrated in the drawings. The body 12 is shaped in the motif of an animal. It contains a clock face 16 having an hour or primary hand 18 and a minute or secondary hand 20. A crystal-like cover 22 protects the hands 18 and 20 and the clock face 16 as in a conventional watch. Projecting through the center of cover 22 is an advancing knob 24. The tail of the characterized animal is an operator button 26. The left and right eyes form display openings 28 and 30, respectively.

Briefly the teaching device 10 works as follows: The child views the hands of the device and can guess what time they are indicating. He ascertains whether or not his guess is correct or not by depressing the operator button 26 which moves an interfering member as hereinafter described and numbered within the interior of the body 12 allowing the child to view the correct time in hours and minutes through the display openings 28 and 30. When the child releases the operator button 26 the minute hand 20 automatically advances to its next position on the clock face 16. The hour hand 18 also advances the appropriate increment corresponding to the advancement of the minute hand 20. The interfering member seals off these openings again. Within the device mechanisms move which position new hour and minute numerals beneath the display openings 28 and 30 corresponding to the new positions of the hands 18 and 20. If the child again depressed the operator button 26 these new numerals will be exposed.

Aside from the automatic advancement of the hands 18 and 20 when the operator button 26 is released the child can also move the hands to any position he wants by turning the advancement knob 24. When this knob 24 is turned mechanisms inside the body 12 automatically maintain the correct numerals corresponding to the positions of the hands 18 and 20 in position beneath the display openings 28 and 30 even though these numerals are not viewable because of the interfering member referred to above which blocks viewing through the openings 28 and 30 unless the operator button 26 is depressed.

Figure 2:
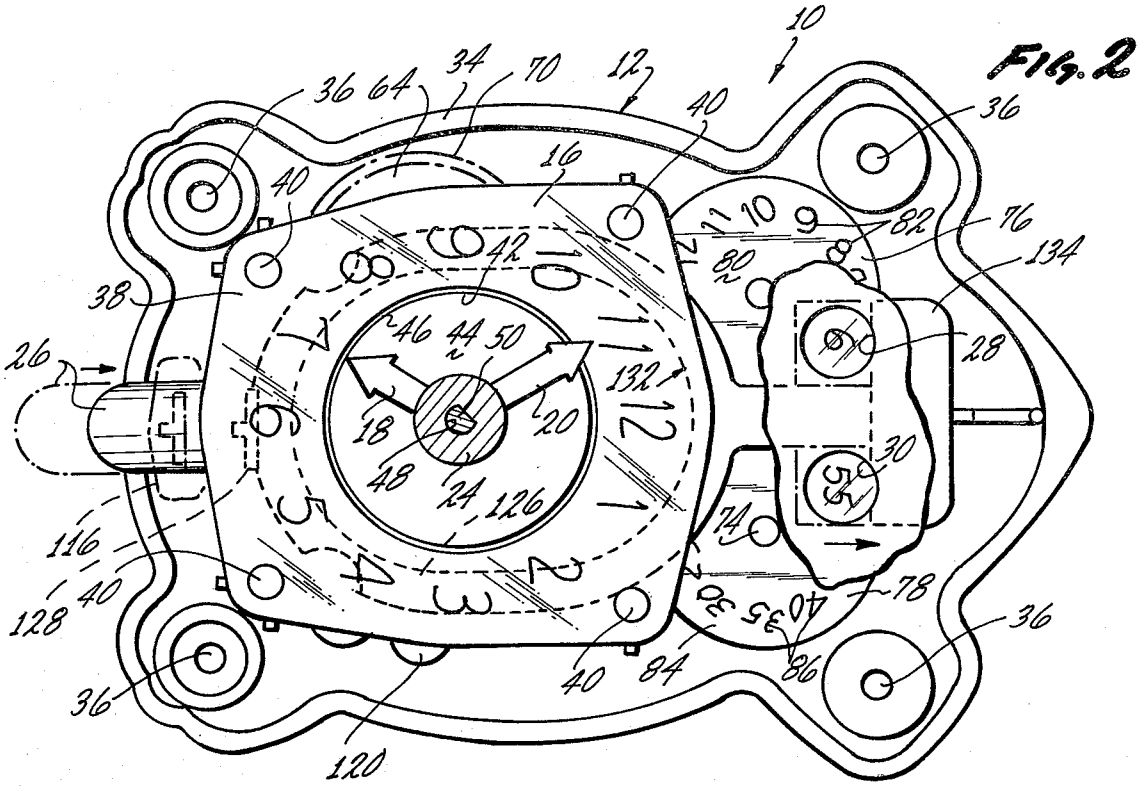
FIG. 2 is a top plan view of the teaching device of FIG. 1 showing those components which lie immediately beneath the upper housing which has been removed.
Figure 3:
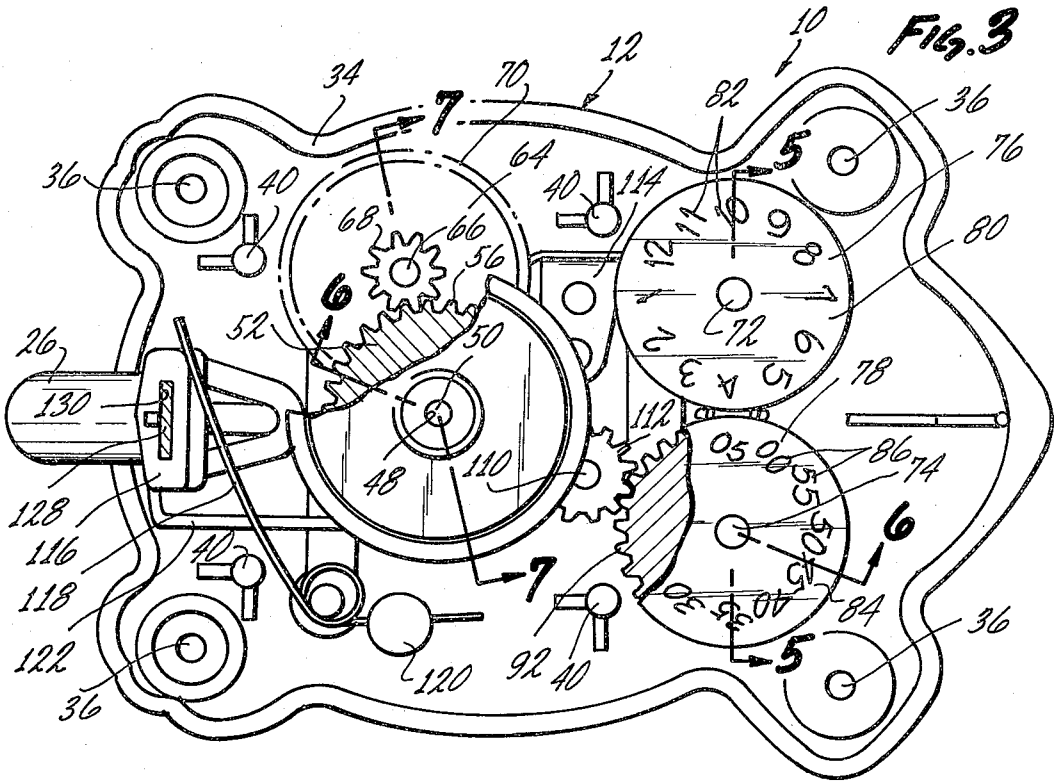
FIG. 3 is a top plan view in partial section similar to FIG. 2 except additional overlying components compared to FIG. 2 have been removed.
Figure 4:
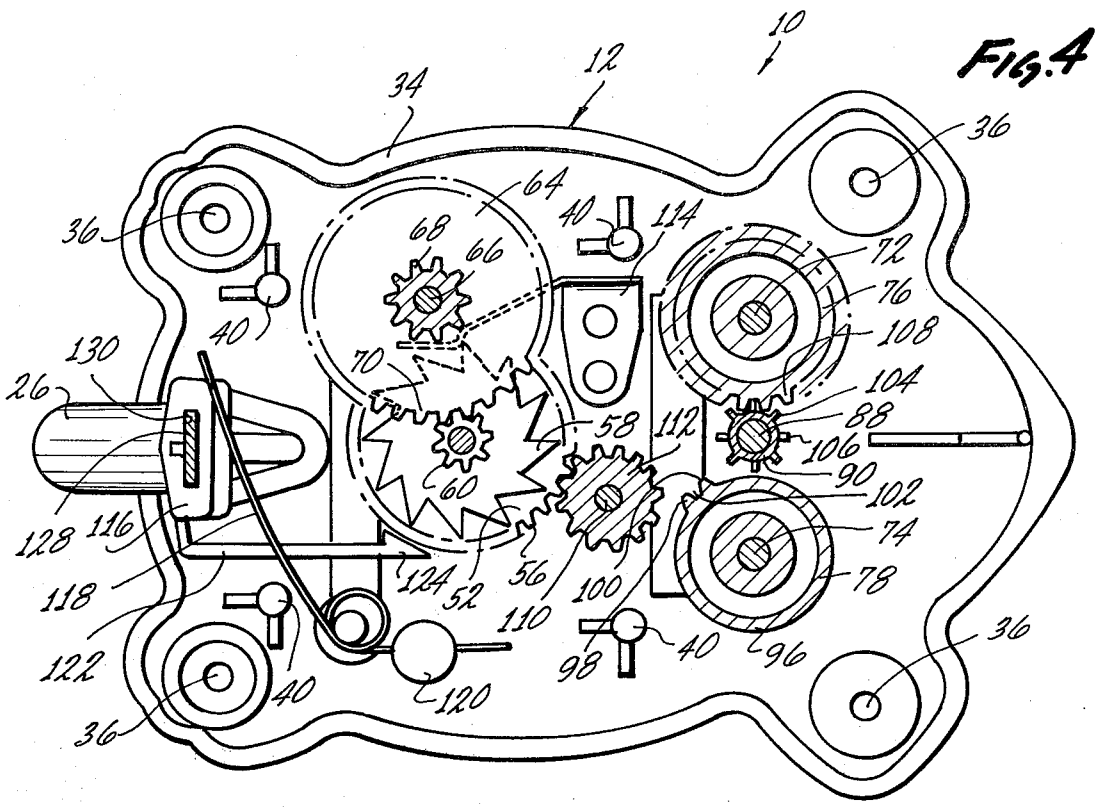
FIG. 4 is a top plan view in partial section similar to FIGS. 2 and 3 except additional overlying components compared to FIG. 3 have been removed.

When the upper housing 32 of the body 12 is removed the interior of the lower housing 34 and parts located therein are exposed as per FIGS. 2, 3 and 4. In FIG. 2 only the upper housing 32 and portions of the advancing knob 24 have been removed. In FIGS. 3 and 4 successive layers of overlying parts are removed. The upper and lower housings 32 and 34 are fixedly held to each other by screws (not shown or numbered) which go through holes 36 in lower housing 34 into other appropriate holes (not shown or numbered) in the upper housing 32.

The clock face 16 is located on dial plate 38 which is appropriately suspended on bosses collectively identified by the numeral 40 projecting upwardly in the lower housing 34. The dial plate 38 has a central cutout 42 through which a portion of disk 14 is exposed. Disk 44 has an upstanding circular flange 46 which keeps disk 44 appropriately positioned within the cutout 42. Disk 44 has a centralized opening 48 in its center which allows disk 44 to be freely slipped over a shaft 50. Hour hand 18 is molded onto the surface of disk 44. Minute hand 20 is molded on the bottom of advancing knob 24. Advancing knob 24 slips over and is keyed to shaft 50. It therefore rotates in response to rotation of shaft 50. The opening 48 in disk 44 is slightly larger than shaft 50 allowing independent movement of the shaft 50 and the disk 44.

Shaft 50 is an upward extension of member 52. A small upstanding boss 54 extends upwardly from lower housing 34 and member 52 is rotatably mounted about boss 54. Member 52 includes a large set of spur teeth 56 near its bottom, a set of ratchet teeth 58 in its midsection and a set of smaller spur teeth 60 adjacent to shaft 50. All of the teeth 56, 58 and 60 as well as shaft 50 are integrally formed as one unit member 52. Therefore rotation of any one of these components results in rotation of the others. Disk 44 has a set of spur teeth 62 on its undersurface.

Referring now to FIGS. 3, 4 and 7 to the left hand side of disk 44 and member 52 is a gear 64 mounted on an upstanding boss 66 projecting outwardly from bottom housing 34. Gear 64 contains a set of spur teeth 68 on its upper surface which mesh with spur teeth 62 on disk 44. A second set of spur teeth 70 on the outer perimeter of gear 64 mesh with spur teeth 60 on member 52. Rotation of member 52 is therefore transferred via gear 64 to rotation of disk 44. The number of teeth on gear teeth 60, 62, 68 and 70 are chosen such that disk 44 rotates 30 degrees for every 360 degrees rotation of member 52, i.e., the hour hand 18 rotates one hour for every 60 minutes rotation of minute hand 20. While the teaching device 10 of the invention is geared primarily to teaching time based on the 12 hour system, it would be also possible to utilize the device 10 for teaching a 24 hour time system or other counting or arithmetic systems. If other than a 12 hour time system is utilized the appropriate gear ratios described for member 52 and disk 44 would have to be changed as well as gear ratios for other components as hereinafter described. The teaching device 10 could be easily modified to teach systems other than the 12 hour system by making such appropriate changes in the gear ratios.

Near the end of lower housing 34 underneath the openings 28 and 30 are located two upstanding bosses 72 and 74. Rotatably mounted over boss 72 is hour indicia member 76. Rotatably mounted on boss 74 is minute indicia member 78. On the upper surface 80 of hour indicia member 76 is a plurality of indicia 82 corresponding to the numerals 1 through 12. On the upper surface 84 of minute indicator member 78 is a plurality of indicia 86 corresponding to the numerals zero through 55 counted by five. The minute indicia is therefore broken down into 5-minute intervals. Other intervals could be appropriately chosen, such as zero, 15, 30 and 45. The indicia 86 is chosen to correspond to 5-minute intervals between the clock face numerals located on the dial plate 38. The minute hand 20 is chosen to move through five-minute intervals for the purpose of describing the preferred embodiment of this invention. By making appropriate changes in the gear ratios, i.e., more specifically the number of ratchet teeth 58, the movement of the minute hand 20 could be made to correspond to intervals other than five minutes.

Projecting upwardly from lower housing 34 between bosses 72 and 74 is a small boss 88. A small pinion 90 is located such that it is free to rotate about boss 88. Minute indicator 78 has a set of spur teeth 92 near its upper perimeter. Directly below spur teeth 92 is a circular shoulder 94. Below shoulder 94 is a second shoulder 96. Shoulder 96 is of a smaller diameter than shoulder 94 which in turn is of a smaller diameter than spur teeth 92. Two gear teeth 98 and 100 are located on shoulder 96. The hollow 102 between these two gear teeth 98 and 100 extends upwardly into shoulder 94. Pinion 90 has four long gear teeth collectively identified by the numeral 104 which extend along its full height. Interspaced between gear teeth 104 are four short gear teeth 106 which extend along only a portion of the height of pinion 90. Short gear teeth 106 are such that they fit against the face (not numbered) of shoulder 96 below shoulder 94. Theoretically they are capable of interacting with gear teeth 98 and 100 on shoulder 96 but gear teeth 104 are such that they cannot fit against the face (not numbered) of shoulder 94. They are only capable of fitting into the hollow 102 on shoulder 94. As such the two gear teeth 98 and 100 can only rotate pinion 90 when they mesh with one of the long gear teeth 104. When they are not meshed with one of the long gear teeth 104 the long gear teeth 104 are held against shoulder 94 which effectively prevents rotation of pinion 90.

Hour indicator member 76 has a set of spur teeth 108 located thereon. The spur teeth 108 interact with and mesh with both long gear teeth 104 and short gear teeth 106. For each complete revolution of minute indicator member 78 movement through pinion 90 to hour indicator member 76 results in movement of hour indicator member 76 through 30 degrees. Thus, every time the minute indicator 78 goes around one complete revolution the hour indicator 76 goes through 1/12 of a revolution.

Located on lower member 34 between boss 54 and boss 74 is a boss 110. A pinion 112 fits on boss 110. Pinion 112 meshes with spur teeth 92 on minute indicator member 78 and spur teeth 56 on member 52. Rotation of member 52 is thus transferred to member 78 and ultimately to member 76. In the preferred embodiment shown for each rotation of member 52 member 78 makes one full rotation and disk 44 and member 76 make 1/12 of a rotation.

Attaching to lower housing 34 is a spring centering member 114. Centering member 114 interacts with ratchet teeth 58. Every time member 52 is turned centering member 114 will interact with the ratchet teeth 58 such that the minute hand 20 comes to rest in line with one of the numerals on the clock face 16. Additionally as will be hereinafter explained the indicia 86 on minute indicator member 78 are appropriately aligned with right display opening 30. The interaction of gear teeth 104 and 106 on pinion 90 with the shoulders 94 and 96 and the locking of gear teeth 108 with gear teeth 104 and 106 cause the indicia 82 on hour indicator member 76 to be lined up with the left display opening 28.

The operator button 26 is formed as part of an operator member 116 which is slidably mounted on lower housing 34. A spring 118 resting against a boss 120 and around one of the bosses 40 biases operator member 116 rearwardly such that the operator button 26 biases into an extended position. When the operator button 26 is depressed inwardly toward the body 12 the operator member 116 energizes the spring 118 and the operator member 116 can be described as being in a depressed position.

A flexible arm 122 extends from operator member 116. A pawl 124 is located on the end of arm 122. Arm 122 is flexible and as such pawl 124 has some freedom of movement with respect to a direction transverse to the direction of movement of the operator member 116. The two positions of the operator member 116 are shown in solid lines and in phantom lines in FIG. 2. When the member 116 is depressed against the bias of spring 118 to the depressed position the pawl 124 rides over one of the ratchet teeth 58 by virtue of flexing of the arm 122 away from the ratchet teeth 58. This allows the pawl 124 to slip over one of the ratchet teeth 58. When the operator member 116 slides from the depressed position to the extended position the pawl 124 locks with a ratchet tooth 58 and as operator member 116 continues to move the member 52 is rotated counterclockwise (see FIG. 4). For the embodiment herein described twelve ratchet teeth 58 are provided on the member 52. Thus, the member 52 rotates through 30 degress under the influence of the interaction of the pawl 124 with a ratchet tooth 58. This corresponds to movement of the minute hand 20 between the sequential five-minute intervals.

Located below dial plate 38 is an interference member 126. Interference member 126 has a key 128 which fits into a slot 130 formed in operator member 116. Interference member 126 is shaped such that it has a circular cutout 134 in it which allows it to fit around disk 44 and therefore there is no transfer of movement between disk 44 or interference member 126. On the end of interference member 126 opposite the end where key 128 is located is interference plate 134. Interference plate 134 is located directly below the display openings 28 and 30.

When the operator member 116 is in its extended position as shown in phantom lines in FIG. 2 the interference plate 134 is in an interfering position as shown in phantom lines in FIG. 2. In this position the interference plate 134 is located between the display openings 28 and 30 and the surfaces 80 and 82 of the indicator members 76 and 78. When the operator member 116 is depressed into its depressed position shown in solid lines in FIG. 2 the interference plate 134 is located in a non-interference position as shown in solid lines in FIG. 2 and the indicia 82 and 86 located on surfaces 80 and 84 of indicator members 76 and 78 are viewable through the display openings 28 and 30, respectively.

I claim:

1. A teaching device which comprises:

a housing;

a simulated clock face and at least one rotating hand located in association with said clock face, both said clock face and said hand located on said housing in position viewable external said housing;

said hand capable of being positioned in a plurality of sequential positions with respect to said clock face;

an indicia carrier means movably mounted on said housing, said indicia carrier means including at least one surface, a plurality of indicia located on said surface, said plurality of indicia each individually corresponding to one of said positions of said hand with respect to said clock face;

said housing including an indicia display means, said indicia carrier means located in association with said indicia display means such that that individual indicia which corresponds with the current position of said hand with respect to said clock face is positioned in a position rendering it capable of being viewed external said housing and is differentiated with respect to said indicia carrier means from all other indicia not corresponding with the current position of said hand with respect to said clock face;

interference means associated with said indicia display means and having an interference position wherein said interference means interacts with said indicia display means such that said individual indicia corresponding to the current position of said hand with respect to said clock face is not viewable external said housing and a non-interference position wherein said indicia corresponding to the position of said hand with respect to said clock face is capable of being viewed external said housing;

hand advancing means associated with said hand and capable of advancing said hand from each of its positions with respect to said clock face to the next sequential of said positions of said hand with respect to said clock face;

coupling means coupling the movement of said hand and said indicia carrier means such that when said hand advances from a position with respect to said clock face to the next sequential position with respect to said clock face said indicia carrier means moves such that the individual indicia corresponding to the sequential position said hand advanced to is positioned in a position rendering it capable of being viewed external said housing and is differentiated with respect to said indicia carrier means for all other indicia not corresponding to the sequential position of said hand with respect to said clock face;

operator means at least a portion of which is located external said housing in a position to be operated on by a user of the teaching device, said operator means operatively associated with both said interference means and said hand advancing means and capable when being acted on by said user to first move said interference means from said interference position to said non-interference position allowing viewing external said housing of said individual indicia which correspond to the current position of said hand with respect to said clock face and next to essentially simultaneously cause (a) said interference means to move to said interference position, (b) said hand advancing means to advance said hand to said next sequential position of said hand with respect to said clock face, (c) in response to said hand being advanced to said sequential position said indicia carrier means moving to position the individual indicia corresponding to the sequential position said hand advanced to with respect to said clock face in a position rendering it capable of being viewed external said housing and differentiating with respect to said indicia carrier means from all other indicia not corresponding to the sequential position of said hand with respect to said clock face.

2. The teaching device of claim 1 including:

two rotating hands located in association with one another and in association with said clock face, one of said rotating hands corresponding to a primary hand and the other of said rotating hands corresponding to a secondary hand, each of said hands capable of being positioned in a plurality of sequential positions with respect to said clock face;

hand coordinating means coordinating the movements of said primary hand and said secondary hand such that said primary hand moves between two sequential positions for each time said secondary hand moves between positions totalling the sum of the increments through which said secondary hand moves in moving through a period equal to the period between two sequential positions of said primary hand;

two indicia carrier means movably mounted on said housing, each of said indicia carrier means including at least one surface, a plurality of indicia located on the surface of each indicia carrier means, said plurality of indicia on one of said indicia carrier means each individually corresponding to one of the positions of said primary hand with respect to said clock face, said plurality of indicia on the other of said indicia carrier each individually corresponding to one of the positions of said secondary hand with respect to said clock face;

carrier coordinating means coordinating the movement of said indicia carrier means containing said indicia corresponding to the position of said primary hand and the movement of said indicia carrier means containing the indicia corresponding to the movement of said secondary hand;

said coupling means operatively associated with both said hand coordinating means and said carrier coordinating means transferring movement of said hand coordinating means to said carrier coordinating means;

both of said indicia carrier means located in association with said indicia display means such that said individual indicia which corresponds with the current position of said primary hand with respect to said clock face and said individual indicia which corresponds to the current position of said secondary hand with respect to said clock face are positioned in position rendering them capable of being viewed external said housing;

said hand advancing means associated with said secondary hand to advance said secondary hand and linked by said hand coordinating means to said primary hand to advance said primary hand.

3. The teaching device of claim 2 wherein:

said housing includes a hollow interior;

said indicia display means comprises at least one opening through said housing into said hollow interior;

said interference means comprises an interference member movably mounted within the interior of said housing in association with said opening whereby in said interference position said interference member is located between both of said indicia carrier means and said opening and in said non-interference position said interference member is not located between said opening and said indicia carrier means.

4. The teaching device of claim 3 wherein:

said hand advancing means includes a gripping member at least a portion of which is located external said housing such that it is susceptible to manipulation by the user of said teaching device.

5. The teaching device of claim 4 wherein:

said operator means includes an operator member, a portion of which is slidably mounted within the interior of said housing and a second portion of which is located exterior said housing in a position accessible to the user of said teaching device;

said interference member is operatively coupled to said operator member and moves between said interference position and said non-interference position in response to movement of said operator member;

said hand advancing means includes a hand actuation means operatively coupled to said operator member and capable of advancing said secondary hand in response to movement of said operator member and said primary hand through said coordinating means linkage between said secondary hand and said primary hand.

6. The teaching device of claim 5 wherein:

one of said indicia carrier means comprises a first rotatably mounted member and the second of said indicia carrier means comprises a second rotatably mounted member, both of said first and said second rotatably mounted members rotatably mounted within the interior of said housing;

said carrier coordinating means comprises a first gear means linking said first and said second rotatably mounted members.

7. The teaching device of claim 6 wherein:

said hand coordinating means includes a shaft rotatably mounted within the interior of said housing, a disk having a centralized opening freely rotatably mounted about said shaft, said primary hand located on said disk, said secondary hand attaching to said shaft;

a second gear means linking movement of said shaft to said disk such that such disk moves in response to movement of said shaft.

8. The teaching device of claim 7 wherein:

said hand actuation means includes a ratchet disk fixedly mounted on said shaft below said disk and a pawl flexibly attaching to said operator member, said pawl interacting with said ratchet disk as said operator member slides with respect to said housing such that said shaft rotates with respect to movement of said operator member.

9. The teaching device of claim 8 wherein:

said coupling means comprises a third gear means, said third gear means operatively associated with both said first gear means and said second gear means transferring movement of said second gear means to said first gear means.

10. The teaching device of claim 9 wherein:

said operator member slides with respect to said housing between an extended position and a depressed position;

biasing means biasing said operator member from said depressed position toward said extended position.

11. The teaching device of claim 10 including:

a position centering means operatively associated with said ratchet disk to center said ratchet disk in a plurality of incremental positions such that when said ratchet disk is centered individual indicia on both said first and said second rotatably mounted members are centered with respect to said opening in said housing.

12. The teaching device of claim 11 wherein:

said housing is shaped as a characterized animal and said opening comprises two openings located in positions corresponding to the eyes of said characterized animal;

said portion of said operator member located exterior said housing is shaped to mimic an external member of said characterized animal.

* * * * *